US005801663A

United States Patent [19]

Lindenmeier et al.

[11] Patent Number: 5,801,663

[45] **Date of Patent: *Sep. 1, 1998**

[54] PANE ANTENNA HAVING AT LEAST ONE WIRE-LIKE ANTENNA CONDUCTOR COMBINED WITH A SET OF HEATING WIRES

[75] Inventors: Heinz Lindenmeier, Planegg; Gerhard Flachenecker, deceased, late of Ottobrunn, by Hildegard Flachenecker, sole heiress; Jochen Hopf, Haar; Leopold Reiter, Gilching, all of Germany

[73] Assignee: Fuba Automotive GmbH, Bad Salzdetfurth, Germany

[ * ] Notice: The term of this patent shall not extend beyond the expiration date of Pat. No. 5,097,270.

[21] Appl. No.: 665,081

[22] Filed: Jun. 14, 1996

Related U.S. Application Data

[63] Continuation of Ser. No. 338,101, Nov. 9, 1994, which is a continuation of Ser. No. 110,538, Aug. 23, 1993, abandoned, which is a continuation of Ser. No. 746,248, Aug. 15, 1991, Pat. No. 5,266,960, which is a continuation of Ser. No. 517,160, May 1, 1990, Pat. No. 5,097,270.

[30] Foreign Application Priority Data

May 1, 1989 [DE] Germany ..... 39 14 424.0

[51] Int. Cl.[6] ..... H01Q 1/32; H01Q 21/00; H01Q 23/00

[52] U.S. Cl. ..... 343/704; 343/713

[58] Field of Search ..... 343/704, 711–714, 343/716, 720, 850, 852, 853, 722, 749

[56] References Cited

U.S. PATENT DOCUMENTS

| | | | |
|---|---|---|---|
| 3,771,159 | 11/1973 | Kawaguchi et al. | 343/729 |
| 4,331,961 | 5/1982 | Davis | 343/704 |
| 4,757,322 | 7/1988 | Yokogawa et al. | 343/712 |
| 4,849,766 | 7/1989 | Inaba et al. | 343/713 |
| 4,864,316 | 9/1989 | Kaoru et al. | 343/704 |
| 4,954,797 | 9/1990 | Shinnai et al. | 343/704 |
| 5,017,933 | 5/1991 | Sakurai et al. | 343/704 |
| 5,097,270 | 3/1992 | Lindenmeier et al. | 343/704 |
| 5,266,960 | 11/1993 | Lindenmeier et al. | 343/704 |

FOREIGN PATENT DOCUMENTS

| | | | |
|---|---|---|---|
| 0054102 | 5/1981 | Japan | 343/704 |
| 0073403 | 4/1986 | Japan | 343/704 |
| 0132402 | 6/1987 | Japan | 343/713 |

OTHER PUBLICATIONS

Translation of Japan Kokai Publication #56–054102 to Fujiki et al. (5–81) 343/704 9 pages.

*Primary Examiner*—Peter Toby Brown
*Attorney, Agent, or Firm*—Michael J. Striker

[57] ABSTRACT

The pane antenna for a very high or ultra-high frequency range includes heating conductors arranged on a window pane between two transverse busbars; at least one wire-shaped conductor forming a first antenna conductor crossing at right angles to at least one heating conductor and coupled by galvanic connection with the heating conductors at a low impedance to create a capacitive antenna region adjoining their crossing points; an antenna terminal outside the heating field on the window pane; a second antenna conductor connecting the antenna terminal with the first antenna conductor and a power supply network for supplying direct current to the busbars without an additional network for increasing impedance connected between the busbars and the vehicle body. The two transverse busbars are arranged so that each heating conductor extends between and is connected with the busbars. The heating conductors have a large inductive impedance per length unit and a distance from the first antenna conductor to each busbar is sufficiently large so that the busbars are sufficiently decoupled from the capacitive antenna region.

9 Claims, 13 Drawing Sheets

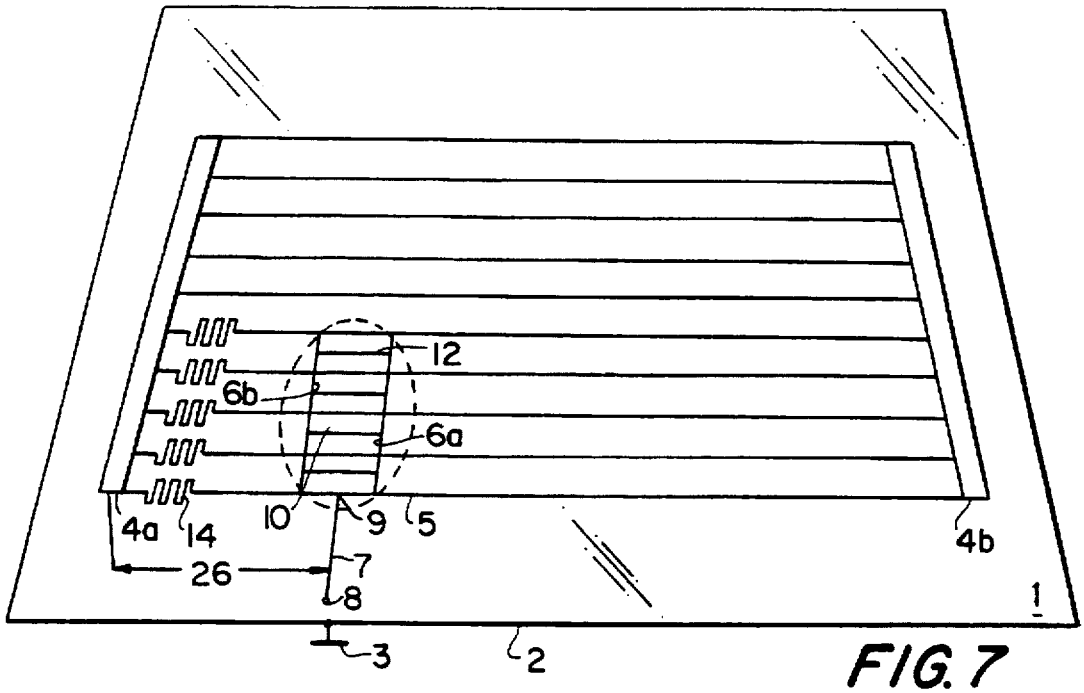
FIG. 7
FIG. 8a
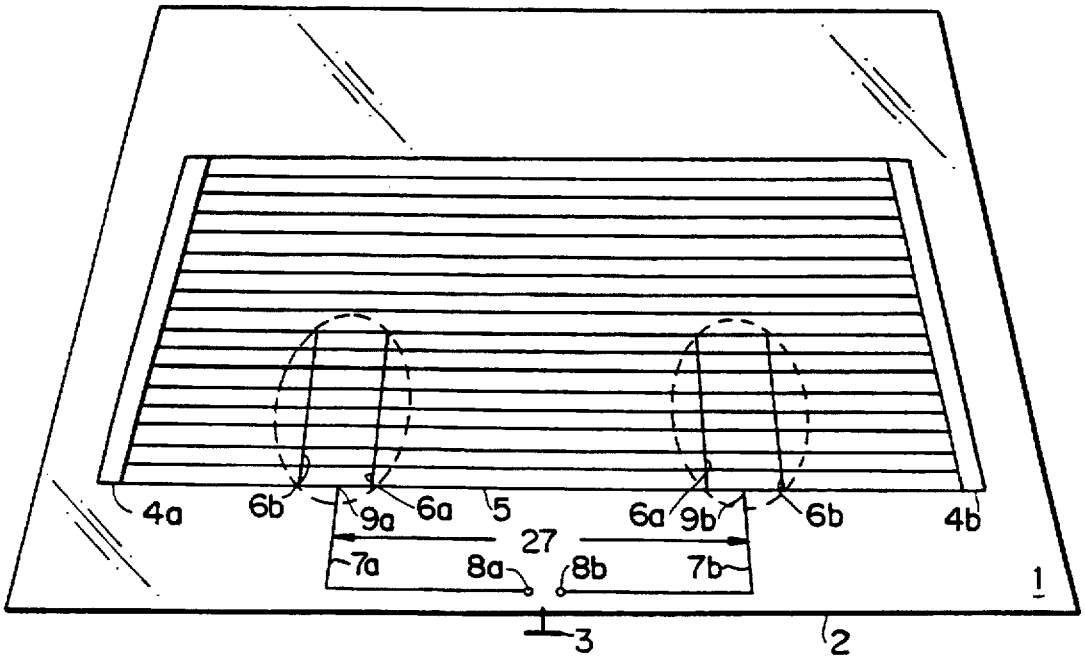

PANE ANTENNA HAVING AT LEAST ONE WIRE-LIKE ANTENNA CONDUCTOR COMBINED WITH A SET OF HEATING WIRES

This application is a continuation of application Ser. No. 08/338,101, filed Nov. 9, 1994 under 37 C.F.R. 1.60, which, in turn, is a continuation of application Ser. No. 08/110,538, filed Aug. 23, 1993, now abandoned, which, in turn, is a continuation of application Ser. No. 07/746,248, filed Aug. 15, 1991, now U.S. Pat. No. 5,266,960, which is a continuation of application Ser. No. 07/517,160, filed May 1, 1990, now U.S. Pat. No. 5,097,270.

BACKGROUND OF THE INVENTION

The present invention relates to an antenna for very high and/or ultrahigh frequencies and includes at least one wire-like conductor arranged in a window pane, for example, in a window pane of a motor vehicle provided with a set of parallel heating wires interconnected by two transverse busbars for applying direct current thereto.

Pane antennas of this kind are known, for example, from the German Patent Publication DE-3618452.A1 and DE-OS 3719692.A1. In these known antennas the heating set or sets on the window pane are utilized for the reception of signals in the range of meter wavelengths. The antenna terminals are located always on the busbars for applying the direct current to the heating wires and at the point in the proximity to a busbar on the metal frame surrounding the window pane, for example in the form of a conductive body of a motor vehicle. The prior art antennas make use of the possibility to tap different reception signals at different points of the busbars and of the conductive frame in order to process the mutually different signals in an antenna diversity system. The antenna conductors and the heating conductors in the case of a single pane window are printed on the glass whereas in the case of a compound or laminated window pane the conductors are in the form of thin wires sandwiched between the glass laminae of the compound window pane.

These known antennas have the disadvantage that the power supply network connected of necessity to the busbars on the window pane in order to apply thereto the heating direct current, considerably affects the impedance conditions of the antennas. Therefore, in order to decouple for high frequencies the busbars from the part of the power supply network which supplies the heating direct current, suitable decoupling networks have been used as illustrated for example in FIG. 1 of the DE 3618452 or in FIG. 1 in DE 3719692. In the motor car technology, such decoupling networks have been made of discrete components whose maintenance and storage is expensive.

Moreover, the number of antenna types which can tap reception signals at the busbars for the heating wires is limited due to the difficulties encountered in decoupling such signals. If it is desired to construct several antennas in combination with the set of heating wires, it has been necessary in prior art technology using the tapping of the antenna signals at the busbars to subdivide the heating field into several portions by interrupting the busbars, so that the individual antennas are decoupled one from the other. For many technological and cost-related reasons, the number of subdivisions of the heating array and the number of the requisite decoupling networks is very limited. Therefore it is desirable to utilize the heating array in the window pane as an antenna, and nevertheless the number of antenna terminals at the busbars should be kept as low as possible.

It has been also known to install one or more antennas consisting of one or more interconnected antenna conductors on the part of the window pane, which is not occupied by the heating array whereby the above described antennas are additionally installed in combination with the heating field. Since usually the portion of the motor vehicle window pane which is free of the heating wires is relatively very small, only a very small number of such antennas can be installed and due to the lack of space, only narrow antennas can be employed even if border antenna structures would be desirable.

SUMMARY OF THE INVENTION

It is therefore a general object of the present invention to provide an antenna for motor vehicle window panes equipped with heating fields which is does not possess the above described disadvantages and which permits installation of further antennas.

In keeping with this object and others which will become apparent hereafter, one feature of this invention resides in a pane antenna which has at least one wire-shaped first antenna conductor crossing at right angles at least a part of the parallel heating conductors, a first antenna conductor and parallel heating conductors are coupled for the effective frequency range in the area of their crossing points to create a capacitive antenna region between sections of the heating conductors adjoining the crossing points, an antenna terminal is provided on the window pane outside the set of heating conductors, and a wire-shaped second antenna conductor is connected at one end thereof to the antenna terminal and, at the other end thereof, coupled for the effective frequency range to the first antenna conductor.

The antenna of this invention, both as to its construction and its method of operation, together with additional objects and advantages thereof, will be best understood from the following description of specific embodiments when read in connection with the accompanying drawing.

BRIEF DESCRIPTION OF THE DRAWINGS

FIG. 7 is a modification of the embodiment of FIG. 5*a* wherein parts of the parallel heating conductors has a meander-like configuration to improve decoupling between the capacitive antenna region and busbars;

FIG. 8*a* shows an embodiment of the antenna of this invention having two capacitive antenna regions arranged in a single set of heating wires and including two antenna terminals assigned to respective antenna regions;

DESCRIPTION OF THE PREFERRED EMBODIMENTS

Figure 1:
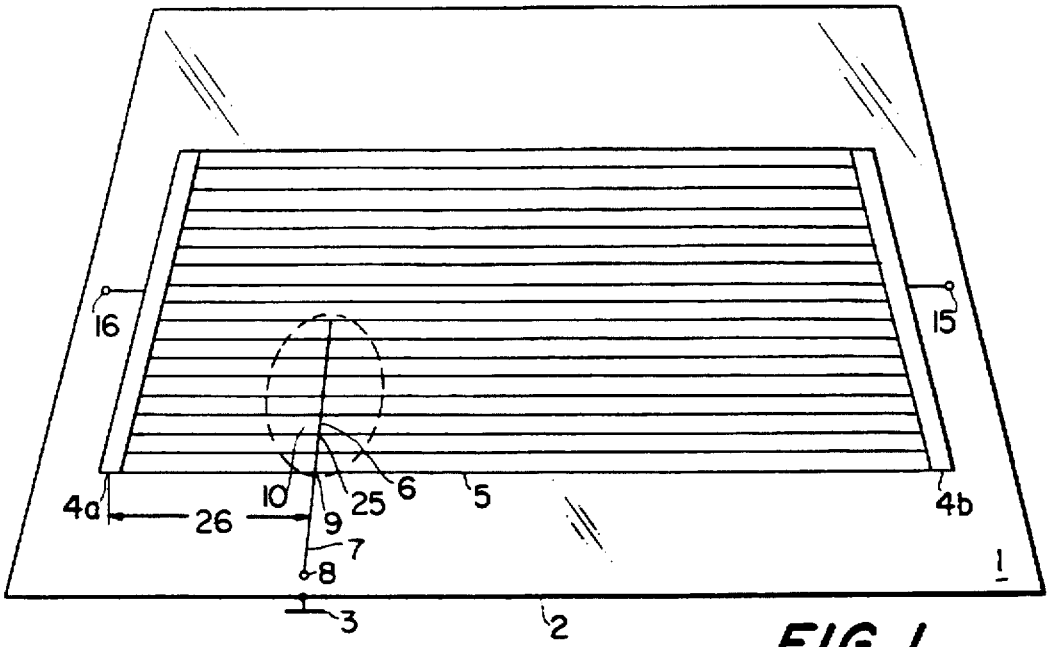
FIG. 1 shows an elevational view of an embodiment of the antenna of this invention, having a single wire-shaped antenna conductor crossing at right angles parallel heating wires.

FIG. 1 illustrates a heatable window pane 1 having a plurality of parallel, in this example horizontally directed heating conductors 5. The busbars 4*a* and 4*b* provided with power supply terminals 15 and 16 are arranged substantially normal to the end portions of the parallel heating conductors. In the case that the parallel heating conductors are oriented vertically the busbars are directed horizontally and all effects described in the following description in connection with the horizontal heating conductors are applicable in analogous manner to the vertically oriented heating conductors. In modern motor cars the defrosting or heating conductors are applied on the upper surface of the vehicle window pane either by a screen printing process. Then they are galvanically reinforced in order to obtain the low resistance value needed for the heating purposes, or in the case of compound or laminated pane windows, the heating conductors are in the form of thin tungsten wires sandwiched between the two glass laminae of a compound window pane.

In either case the heating conductors 5 are wire-shaped. The area of the window pane covered by the heating field as a rule is such large that only relatively narrow strips of free glass surface remain above and below the heating field. The narrow size of the free glass regions does not permit the realization of antennas for the meter wavelength range having the reception quality described in the beforementioned German Publication DE 3719692 A1.

It is known from prior art that a heating field or array of this kind can be employed as an antenna for frequencies above very high frequency range provided that the antenna terminal is on a busbar of the heating conductors. FIG. 1 shows the basic arrangement of an antenna of this invention which avoids the disadvantageous effect of the prior art antenna conductor connected to the busbar for applying the heating direct current. The antenna of FIG. 1 consists of the parallel heating conductors 5, a wire-shaped first antenna conductor 6 and a second antenna conductor 7. The invention aims at creating a coupling to the heating conductors 5 which establishes a capacitive antenna region.

The contour of the capacitive antenna region is indicated by a dashed line. It is formed along the first wire-like antenna conductor 6 which crosses substantially at right angles the parallel heating wires 5. The crossing points 25 of the antenna conductor 6 are coupled with the sections of the parallel heating conductors within the capacitive antenna region 10 at a relatively low impedance for the effective frequency range. Due to the wire-shaped configuration of the heating conductors, a relatively large inductance per length unit of the heating wires is achieved.

The specific inductance of the heating wires has the effect that, in the effective frequency range above the high frequencies, conductive elements connected to the heating conductors, such as for example the busbars 4*a* and 4*b* are sufficiently decoupled for the high frequencies. That means that the capacitive antenna region 10 is largely unaffected, as far as the high frequencies are concerned, by the connection of the busbars 4*a* and 4*b*, provided that the distance 26 of the first wire-shaped antenna conductor 6 is sufficiently large from the busbars. The distance 26 therefore must be selected according to the particular decoupling requirements and according to the construction and the number of the crossed heating conductors. It is essential that the first wire-shaped antenna conductor 6 be arranged such as to couple with the parallel heating conductors at a relatively low impedance for the effective frequencies, thus creating the capacitive antenna region 10. Coupling of the capacitive antenna region 10 to the antenna terminal 8 at the rim of the pane 1 is performed by the second wire-shaped antenna conductor 7. The grounding antenna terminal 3 is arranged at a point of the conductive frame 2, opposite the antenna terminal 8.

The antenna signal is picked off between the terminals 8 and 3. Furthermore, it is also essential for the antenna of this invention that a low impedance coupling be established for high frequencies at the crossing points 25 between the parallel heating conductor 5 and the transverse wire-shaped first antenna conductor 6. If the wire-shaped antenna conductor 6 and the heating conductors 5 are printed on the pane, then automatically a galvanic connection between the antenna conductor 6 and the heating conductors 5 is obtained and a condition for a cost-effective manufacturing of the antenna is met, because the printing of isolated crossing points of the conductors is technologically substantially more difficult to realize.

In the case of a compound or laminated window pane where the heating wires at the first antenna conductor 6 are inserted between the component glass panes, the galvanic contact between the conductors 5 and 6 is established when both types of conductors are applied on the same side of a plastic foil which is interposed between the component glass panes to bond the same at an increased temperature. However, it is not unconditionally necessary that at each of the crossing points 25 a galvanic contact is created inasmuch as the clearance between the crossing conductors embedded in the compound window panes is so small that the capacitive coupling resulting at the crossing points for the frequencies above the high frequency range has a very low impedance that it is comparable in its electrical effect to a direct galvanic connection. Also, in the case when the heating conductors 5 and the first antenna conductor 6 are arranged on opposite sides of the insulating adhesive foil, that means if they are galvanically separated, there still remains a sufficiently strong capacitive coupling for high frequencies which suffices for the creation of a capacitive antenna region 10 as it will be explained later on in connection with FIGS. 10*a* through 10*c*.

If galvanic connections take place at the crossing points 25, the first antenna conductor 6 creates undesired shunts for the heating direct currents through which equalizing current portions may flow between the parallel heating conductors 5. Such equalizing or transient currents may change the defrosting properties of the heated window pane in a non desired way. In the embodiments of the antenna of this invention wherein the crossing points of the antenna conductor and the heating conductors are galvanically connected, the formation of the equalizing partial currents is eliminated if the crossing points coincide with the points of equal potential at the respective heating conductors 5, that means the crossing points 25 are interconnected by the antenna conductor along a line which connects the same voltage level, so that no equalizing currents in the antenna conductor 6 can develop.

An antenna of the invention similar to the embodiment of FIG. 1 can be constructed also in combination with parallel heating conductors oriented in vertical direction. The first antenna conductor 6 is again guided along an equipotential line with respect to the heating conductors which in the latter case is oriented substantially along a horizontal line.

Figure 2:
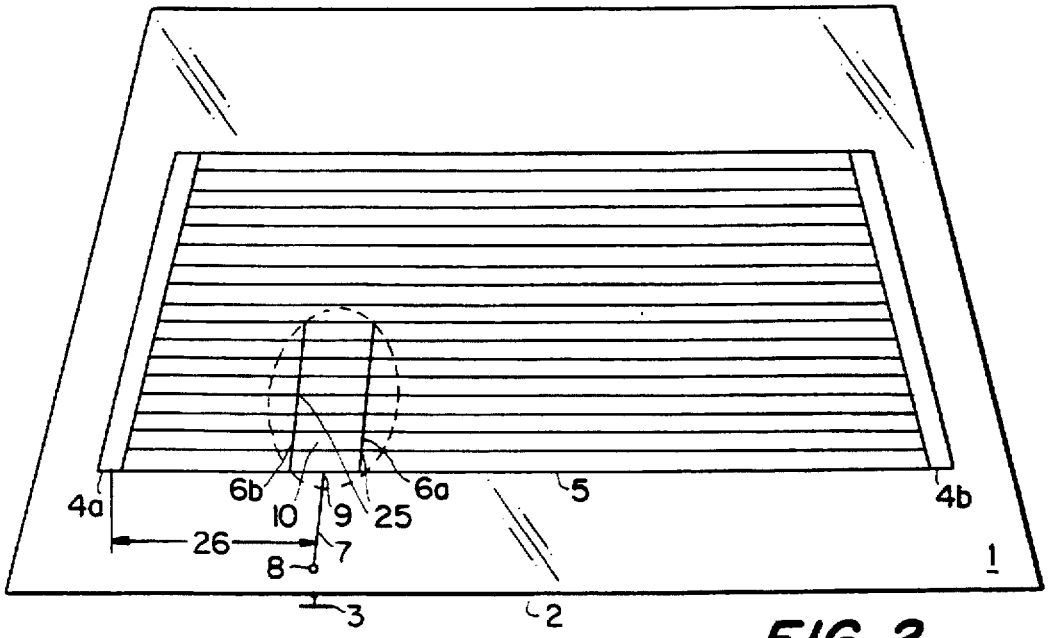
FIG. 2 shows an embodiment of this invention including two wire-shaped antenna conductors arranged side-by-side and crossing the parallel heating wires to increase a capacitive antenna region.

A particularly advantageous embodiment of a capacitive antenna region 10 is illustrated in FIG. 2 in which two wire-shaped first antenna conductors 6*a* and 6*b* are arranged side-by-side along equipotential lines of the heating voltage on the respective parallel heating conductors 5. In this example, the two antenna conductors 6*a* and 6*b* extend substantially normal to the horizontal heating conductors 5. The coupling of the capacitive antenna region 10 to the antenna terminal 8 is effected by the second wire-shaped antenna conductor 7 at a connection point 9 which is located on one of the heating conductors 5. In this embodiment the connection point 9 is approximately midway between the antenna conductors 6*a* and 6*b*. By selecting a sufficiently large distance 26 between the busbar 4*a* and the wire-shaped second antenna conductor 7, sufficiently large decoupling of the capacitive antenna region 10 from the busbars is achieved. The distance between the two first antenna conductors 6*a* and 6*b* should not exceed a certain optimal value.

Figure 3:
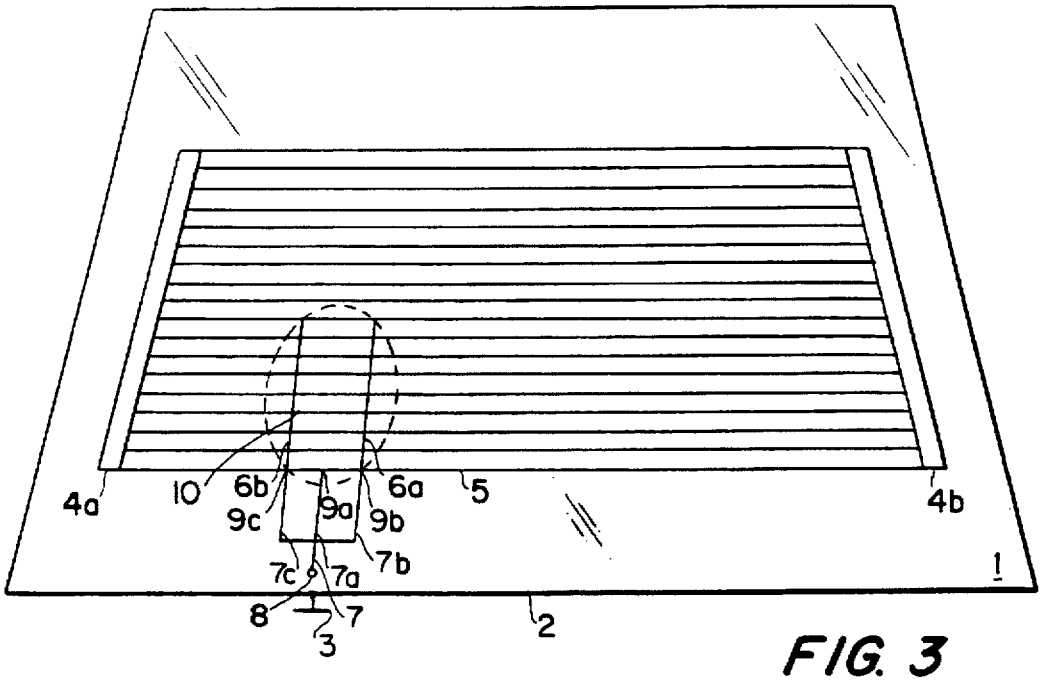
FIG. 3 is a modification of the embodiment of FIG. 2 having a low inductance coupling of antenna terminals to the capacitive antenna region.

An advantageous further development of this invention relates to construction of the wire-shaped second antenna conductors 7*a* through 7*c* as shown in FIG. 3. This arrangement leads to a reduction of the effective inductance of the second antenna conductors causing an increase of their capacitance so that the total capacity of the antenna at the antenna terminal 8 is defined substantially by the capacity of the capacitive antenna region 10 and the capacitive area defined by the second antenna conductors 7*a* through 7*c*.

Figure 4:
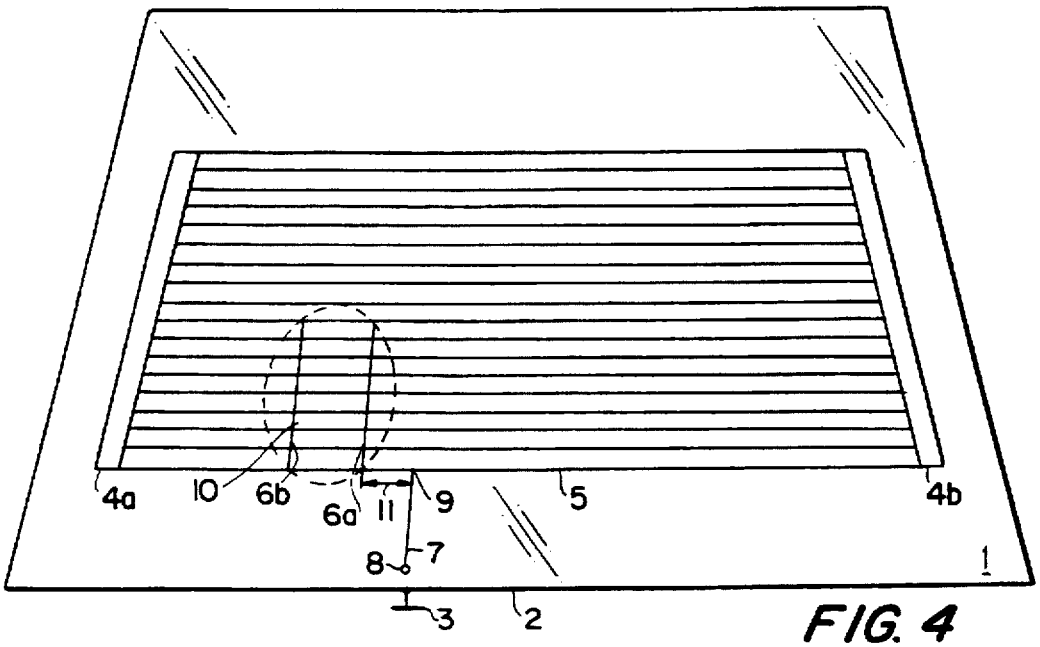
FIG. 4 is another modification of the embodiment of FIG. 2 wherein an antenna terminal is offset relative to the capacitive antenna region.

In motor vehicles, it may be necessary to place for technical reasons the connection point 9 on a heating wire 5 at a distance 11 from the first antenna conductor 6*a*. However, to insure a sufficient coupling to the capacitive antenna region 10, the distance 11 must be selected relatively small, as shown in FIG. 4.

Figure 5A:
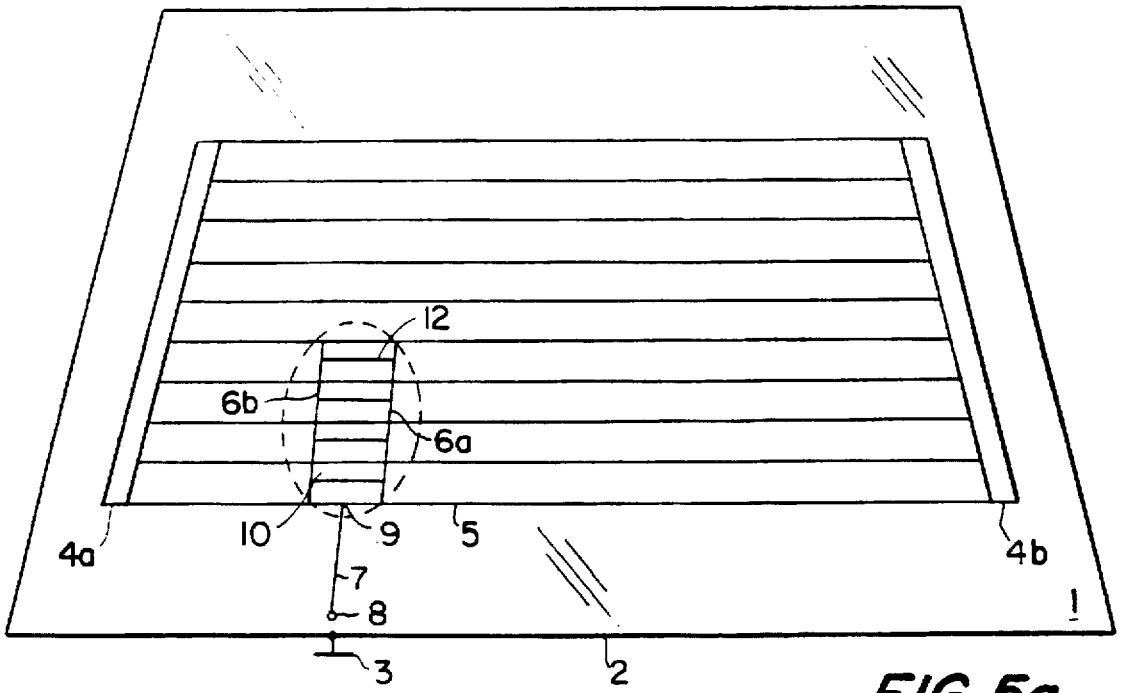
FIGS. 5*a* shows an embodiment of the invention including two wire-shaped antenna conductors arranged side-by-side across the parallel heating conductors and connected by additional conductors extending parallel to the heating wires to increase the capacity of the capacitive antenna regions.
Figure 5B:
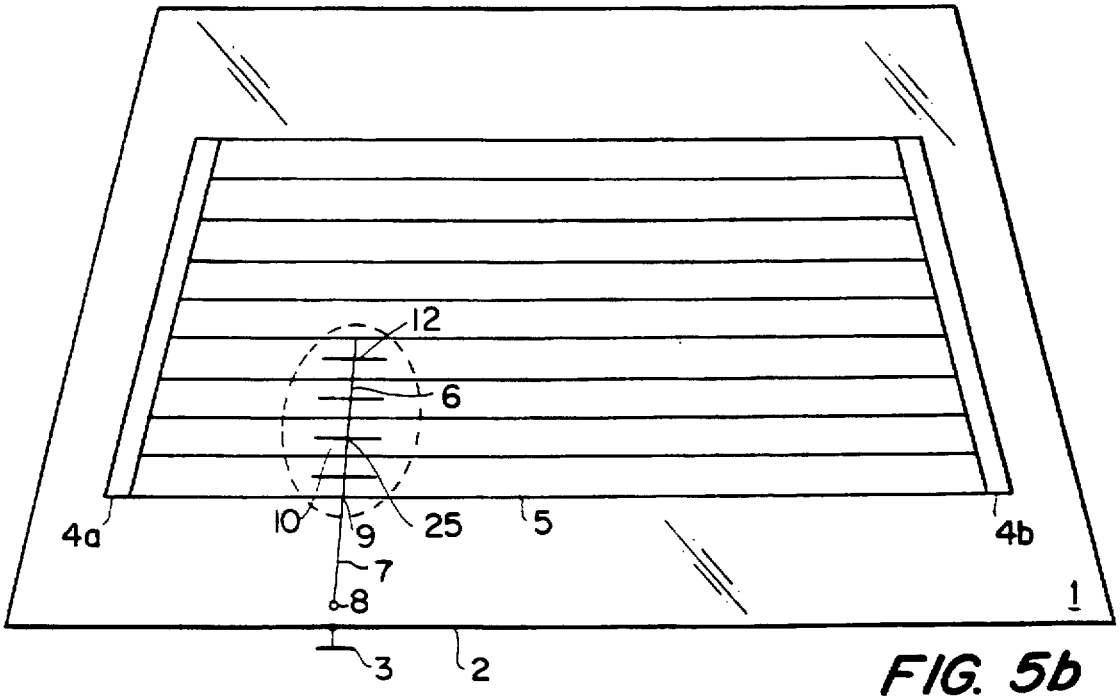
FIG. 5*b* is similar to the embodiment of FIG. 5*a*, but using only a single wire-shaped antenna conductor.
Figure 5C:
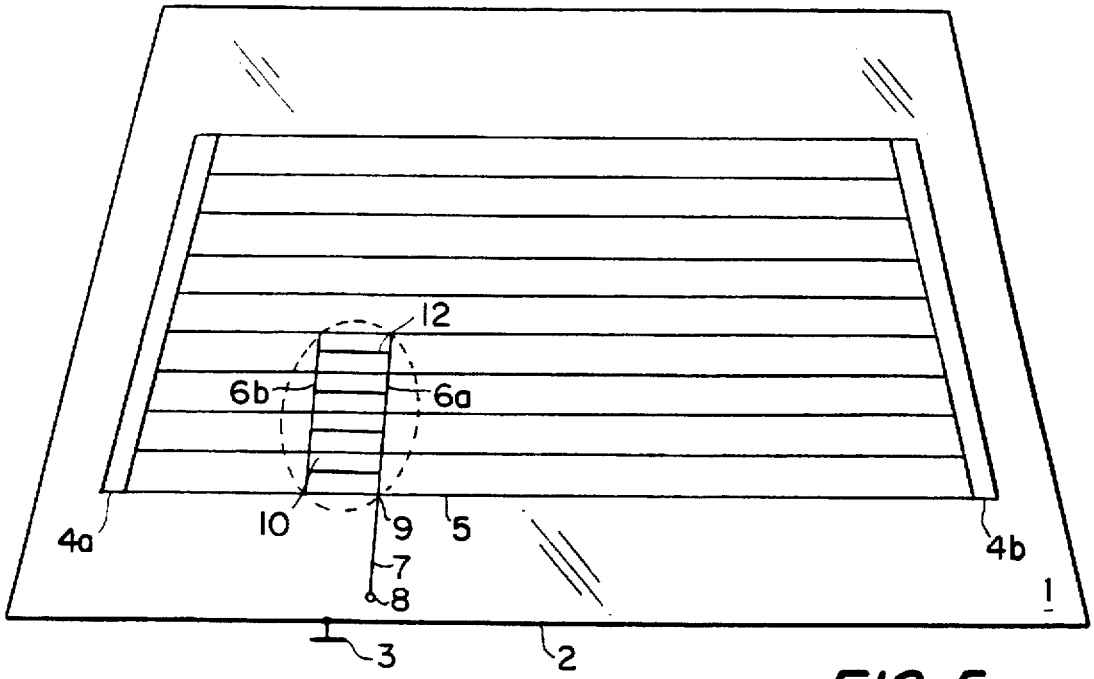
FIG. 5*c* is similar to the embodiment of FIG. 5*a*, but having an asymmetric arrangement of a second antenna conductor relative to the capacitive antenna region.

In a further advantageous embodiment of the antenna of this invention as shown in FIGS. 5*a* through 5*c*, the first antenna conductors 6*a* and 6*b* are interconnected by parallel conductor sections 12 or the first antenna conductor 6 supports the parallel conductor sections 12 extending between the assigned heating conductors 5, thus increasing the capacitive antenna region 10.

Figure 6:
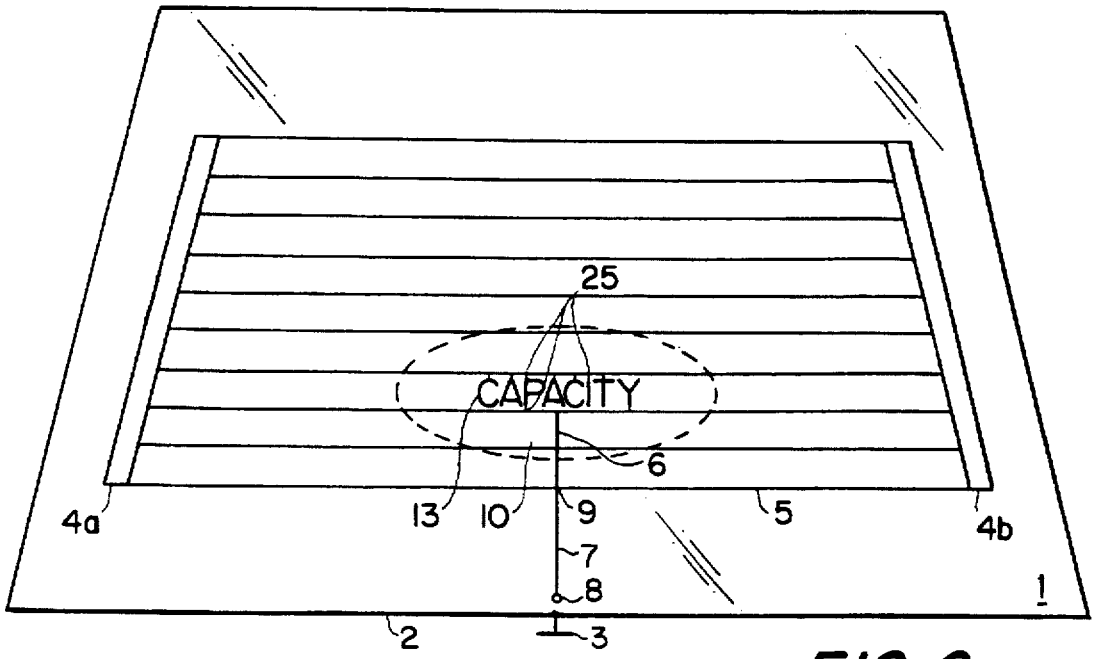
FIG. 6 shows an embodiment similar to the embodiment of FIG. 1 wherein the capacity of the capacitive antenna region is increased by means of ornamental or descriptive signs of a conductive material.

Referring to the embodiment of FIG. 6, the capacitive antenna region 10 can be modified and effectively increased by the provision of conductive ornamental or descriptive signs 13 arranged between two facing healing conductors 5 whereby the crossing points 25 of the signs 13 with the heating conductors provide a low impedance coupling for the effective frequency range.

If for some reason or other the distance 26 (FIG. 1) between the capacitive antenna region 10 and the busbar 4*a* cannot be made sufficiently large or if the corresponding portion of the heating conductors has an impedance for the effective high frequency which is too low to provide the requisite decoupling of the capacitive antenna region from the busbar then the decoupling can be increased by the introduction of inductive elements in the corresponding portions of the heating conductors. In the embodiment of FIG. 7, it is achieved by inductances 14 formed by a meander-like configuration of portions of the heating conductors 5 between the busbar 4*a* and the capacitive antenna region 10. The inductance of the heating conductors 5 can be also increased by the application of a ferrite material thereon. In the case of the meander-like configuration of the heating conductor portions, the inductivity can be further increased by glueing a small ferrite plate on the meander structure.

All antennas of this invention have the advantage that the power supply network for applying direct current to the heating field can be connected to the busbars without additional separate networks for increasing impedance between the busbar and the vehicle body. In the case that the impedance correcting networks are still needed, by a corresponding selection of a larger distance 26 such networks can be designed with a smaller size and a substantially lower cost.

In most cases parallel heating conductors are arranged substantially horizontally in the window pane of a motor vehicle. However, in antennas for the wireless telephone and also in antennas of the ultrashort broadcasting wavelength range in some countries, the reception of vertically polarized waves is required.

On the basis of the slot configuration represented by a window pane installed in a conductive body of a motor vehicle, strong vertical electromagnetic fields build up particularly in the central region of the window pane. The vertically oriented wire-shaped first antenna conductor in connection with the vertically oriented second antenna conductor create, together with the present metal frame 2 (FIGS. 1 through 7) a vertically oriented unipole whose capacitive top load is represented by the capacitive antenna region.

Consequently, the vertically polarized electrical fields whose intensity increases with the distance 26 of the vertical unipole from the vertical metallic rim of the pane, attain a particularly good reception. Prior art antennas whose antenna terminal is located on busbars do not possess this advantage and receive preferably electromagnetic waves with a horizontal polarization. In the antennas of this invention it is of advantage that both the horizontally as well as the vertically polarized waves can be effectively received.

In a further advantageous embodiment of the invention as shown in FIG. 8a, two capacitive antenna regions are created within a heating field. Second antenna conductors 7*a* and 7*b* are connected to the respective capacitive antenna regions at connection points 9*a* and 9*b* at the lowermost heating conductor and lead to separate antenna terminals 8*a* and 8*b*. Together with a conductive frame 2 and the grounding point 3 located on the frame in proximity to the antenna terminals 8*a* and 8*b*, three antenna voltages are tapped during the reception.

The antenna voltages are tapped between the antenna terminal 8*a* and the grounding point 3, the antenna terminal 8*b* and the grounding point 3 or between the two antenna terminals 8*a* and 8*b*. This antenna arrangement acting as three different antennas can be employed with advantage for example in an antenna diversity system. Also in case when the window pane is installed in a broad plastic frame surrounded by the metal frame 2 such that the latter is not in an immediate proximity to the window pane, it is possible in this embodiment to realize an antenna at which both in the reception and in the transmission mode of operation the received voltage can be tapped off and the transmitted voltage can be fed into the antenna terminals 8*a* and 8*b*.

Figure 8B:
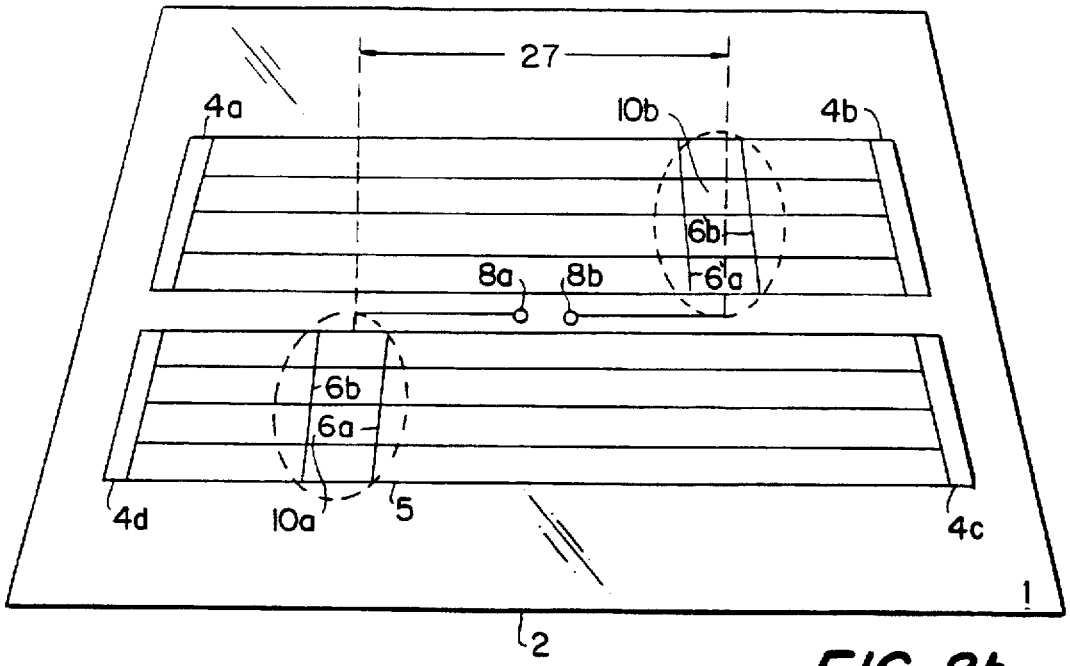
FIG. 8*b* shows an embodiment of the antenna of this invention having two capacitive antenna regions arranged respectively in separate heating sets, and provided with two separate antenna terminals.

In the embodiment of the antenna illustrated in FIG. 8*b* there are also used two capacitive antenna regions 10*a* and 10*b*. To increase the decoupling of the two antenna regions one from the other the first antenna conductors 6*a* and 6*b* of the antenna regions 10*a* and 10*b* are arranged in different heating fields which are separated one from the other for frequencies and are supplied with the heating direct current via separate pairs of busbars 4*a*, 4*b* and 4*c*, 4*d*. Similarly as in the embodiment of FIG. 8*a*, the capacitive antenna regions 10*a* and 10*b* are spaced apart in horizontal direction by a distance 27. In addition, due to the superposed arrangement of the two capacitive antenna regions in two separate heating fields having antenna terminals 8*a* and 8*b* arranged at a central position of the window pane, there results a dipole-like antenna which extends both in the vertical and in the horizontal direction and accordingly, is suitable for the reception both of the vertically polarized and of the horizontally polarized waves.

Figure 8C:
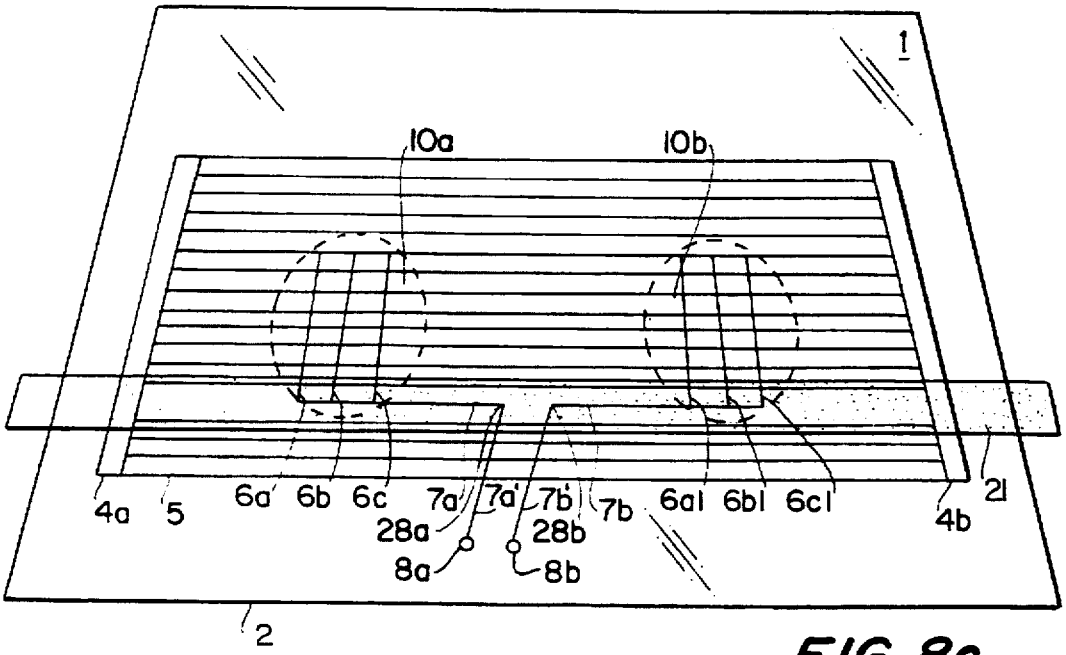
FIG. 8*c* shows the embodiment of two antennas of this invention arranged side-by-side in a single heating field, each antenna having three wire-shape antenna conductors extending side-by-side across parallel heating wires and each connected to a separate antenna terminal via a second antenna conductor, wherein second antenna conductors are partially covered by a conductive member arranged perpendicularly to the window pane, such as spoiler or airfoil plate.

In the embodiment of the antenna of the invention shown in FIG. 8*c* there are again provided two capacitive antenna regions 10*a* and 10*b* in a single heating field. The second antenna conductors 7*a* and 7*b* are first guided in horizontal direction to points 28*a* and 28*b* on the pane 1 and therefrom the parts 7*a*' and 7*b*' of the second antenna conductors are guided perpendicularly to the bottom rim of the pane and connected to the assigned antenna terminals 8*a* and 8*b* which in this example are located in the range of a plastic spoiler plate 21. Of course, the horizontal second antenna conductors 7*a* and 7*b* in FIG. 8*b* can be constructed as a modified heating conductor extending up to the assigned busbars 4*a* and 4*b* and the gap between the antenna terminals 8*a* and 8*b* can be bridged by a suitable choke inductance providing path for the heating direct current.

Figure 9:
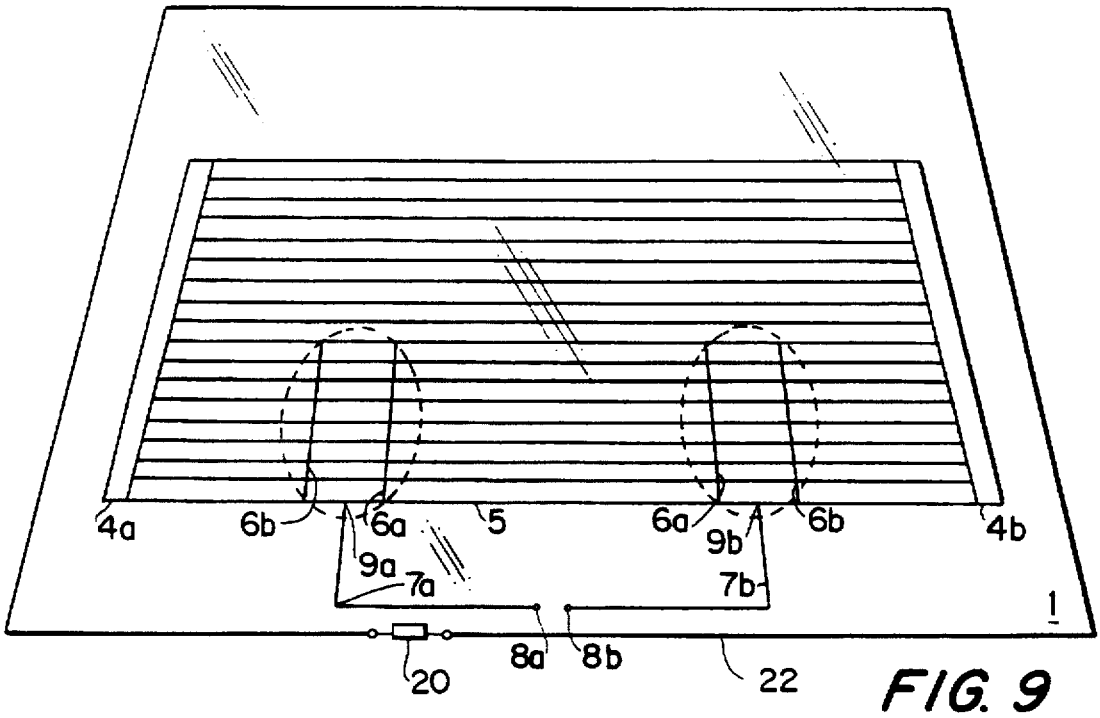
FIG. 9 shows an embodiment of the antenna of this invention similar to FIG. 8*a* but having an interrupted peripheral frame of a conductive material and the interruption bridged by a complex impedance matched for a resonance.

A further modification of the antenna according to this invention installed in a window pane surrounded by a broad plastic frame upon which a conductive frame 22 is applied by a printing process, is illustrated in FIG. 9. To improve antenna performance during the transmitting or receiving mode of operation the conductive frame 22 is interrupted at a suitable point and is tuned to resonance for a desired frequency by connecting a complex impedance 20 in the interruption.

Figure 10A:
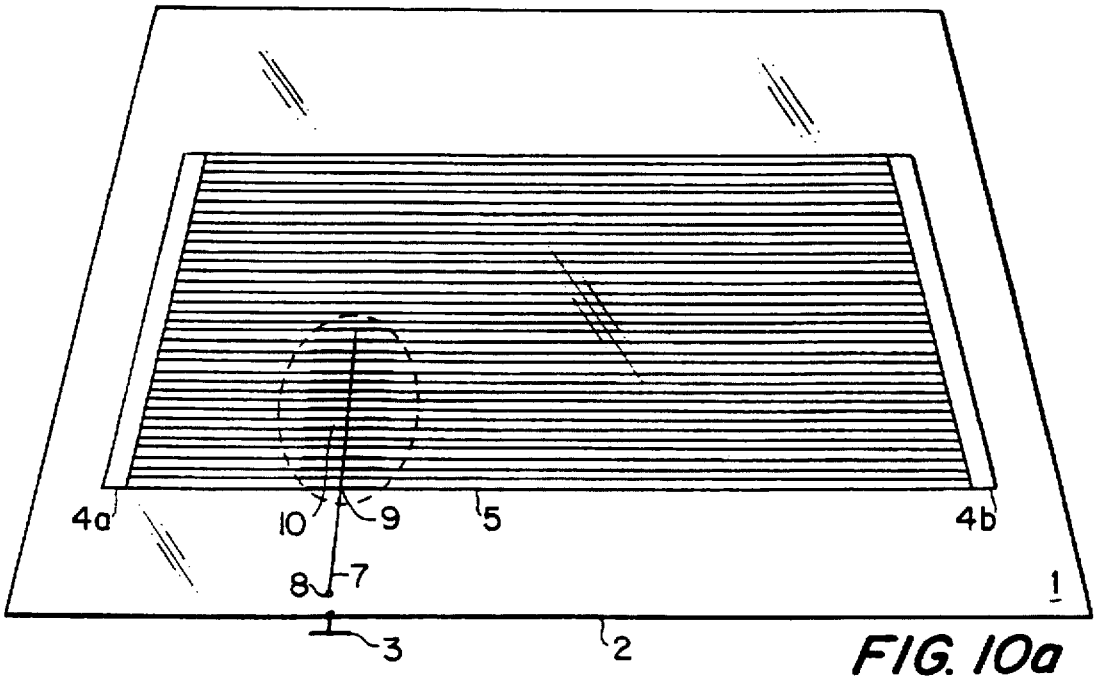
FIG. 10*a* shows an embodiment of the antenna of this invention printed within a compound laminated window pane.
Figure 10B:
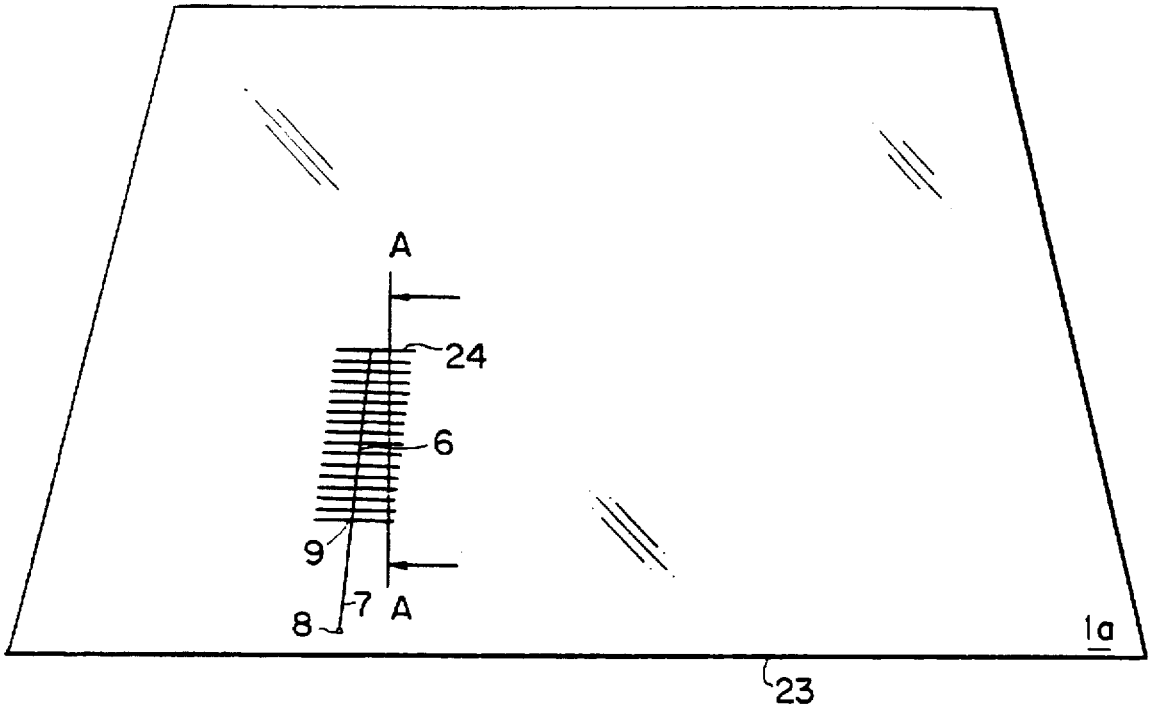
FIG. 10*b* shows a modification of the antenna of FIG. 10*a*, wherein a conductor which printed on the antenna is provided with additional conductor sections extending parallel between the heating conductors to increase capacity of the capacitive antenna region.
Figure 10C:
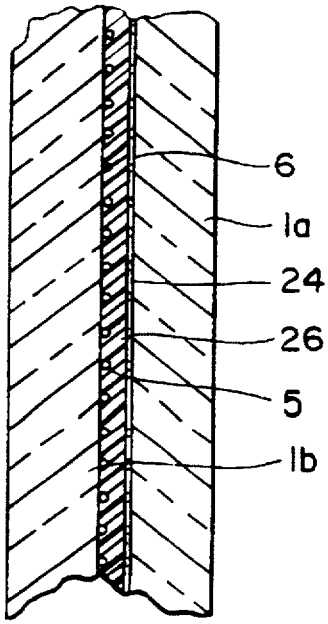
FIG. 10*c* is a sectional side view, shown on an enlarged scale of the embodiment of the antenna of FIG. 10*a* or 10*b* within a laminated window pane.

In FIG. 10*a* there is illustrated a compound or laminated pane 1. In the preferred embodiment of this invention the antenna is constructed in such a manner that the heating conductors 5 are in the form of thin wires embedded in one side of an insulating thermoplastic foil 26 (FIG. 10*c*). The wire-shaped first antenna conductor 6 is applied on the other side of the insulating foil 26 such that a relatively large capacitive coupling results between the first antenna conductor 6 and the heating conductors 5. In order to further increase the capacitive coupling the first antenna conductor 6 is provided with parallel conductor sections 24 shown in FIG. 10*b* which extend parallel to the heating conductors 5. The entire assembly of the antenna conductors consisting of the second antenna conductor 7, the first antenna conductor 6 and the parallel conductor sections 24 preferably printed on the component glass pane 1*a*, is shown in FIGS. 10*b* and 10*c*.

Figure 11:
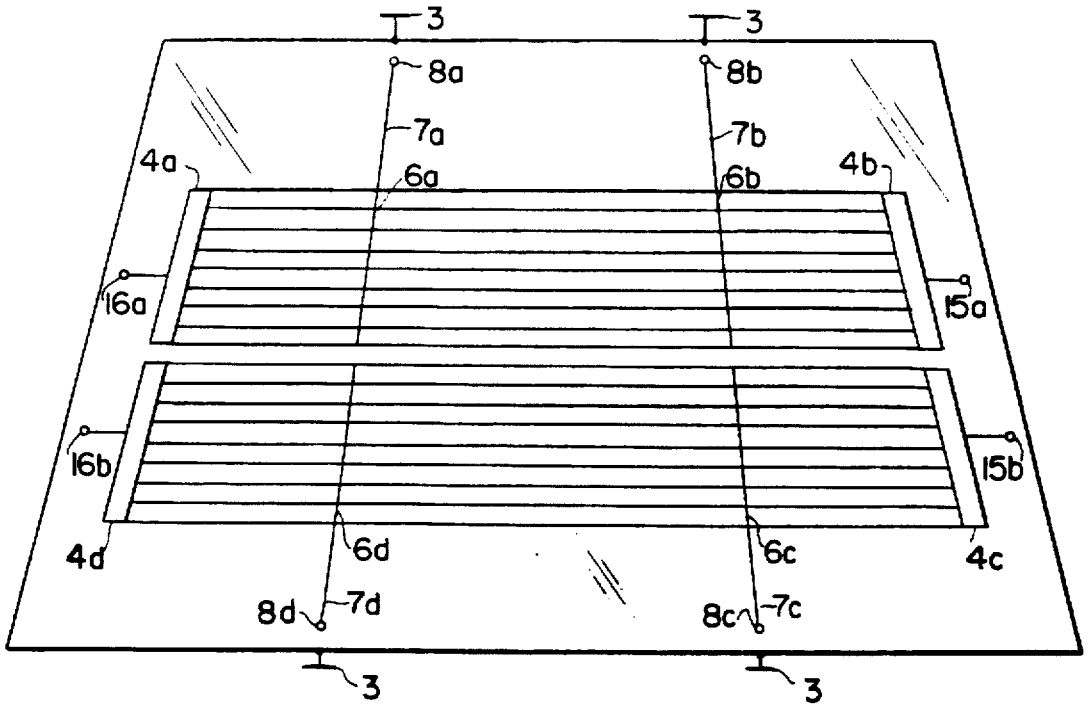
FIG. 11 shows an embodiment including four antennas of this invention arranged in two separate heating fields such that the antenna conductors in respective heating fields are separated one from the other by a relatively long heating conductor.

For the application of an antenna diversity system it is necessary to use a large number of antennas having mutually different receiving properties. Especially in the case when the entire window pane is to be heated and consequently the heating structure covers the entire surface of the pane it is desirable to provide a multiple utilization of the heated pane for the antenna design. This multiple use necessitates however an effective decoupling of the individual antennas formed in the heating field. In this manner the heating field is divided into a plurality of antennas according to the invention. This is realized in the example of FIG. 11 for a heated window pane provided with a peripheral metal frame 2. The busbars for the heating conductors are interrupted and supplied with heating direct current via terminal pairs 15*a*, 16*c* and 15*b*, 16*b*. Each heating field includes two vertical first antenna conductors 6*a*, 6*b* and 6*c*, 6*d* connected respectively via second antenna conductors 7*a*, 7*b* and 7*c*, 7*d* to antenna terminals 8*a*, 8*b* and 8*c*, 8*d*. Opposite the individual antenna terminals there are provided grounding points 3 on the metal frame 2. In this manner four mutually decoupled antennas of this invention are created.

Heating currents are supplied via the busbar terminals 15*a* through 16*b*. This arrangement enables also the provision of further four antenna terminals on the busbars as long as their terminals 15*a* through 16*b* are connected to the supply of the heating current via suitable decoupling networks. The grounding connection for the respective heating current terminals 15*a* through 16*b* can be also located on the conductive frame 2 close to the assigned terminals. By virtue of this invention it is possible to utilize the heating field not only for the creation of four antennas known from prior art but also with additional four antennas according to the invention, that is in total eight antennas while using only four decoupling networks for feeding the heating direct current.

Figure 12:
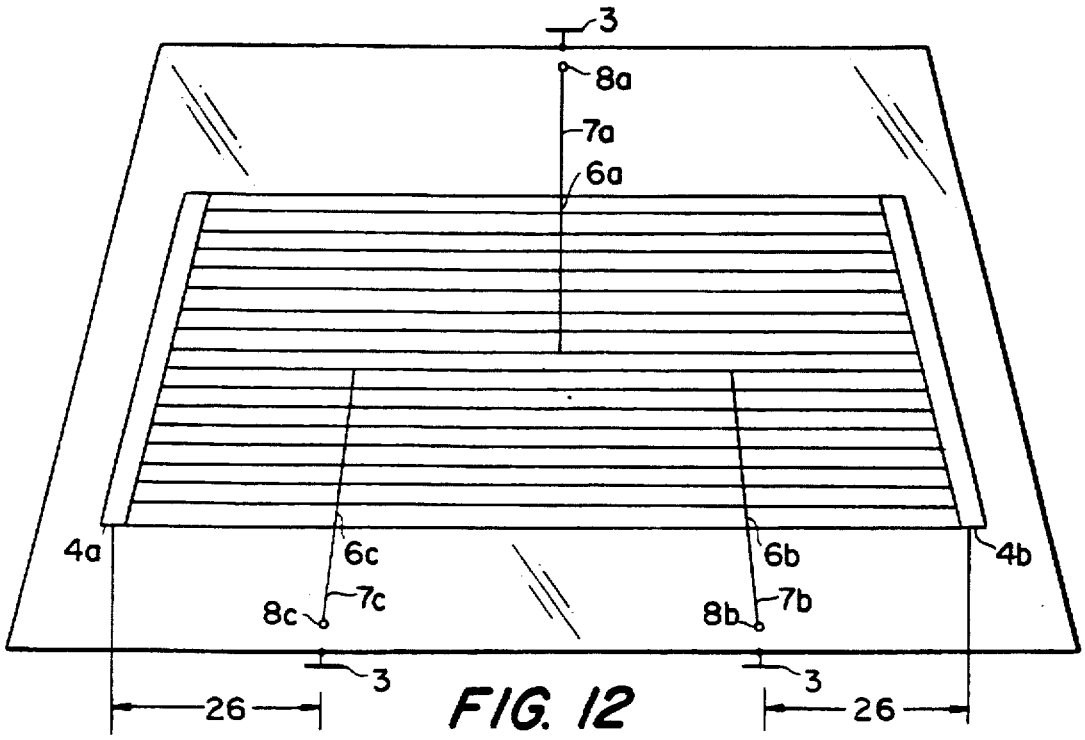
FIG. 12 shows a modification of the embodiment of FIG. 11 having three antennas of this invention arranged in a single heating field.

In the case of smaller number of antennas according to the invention, the busbars for the heating wires have no antenna terminals and by a suitable distribution of the first antenna conductors 6a through 6c illustrated in FIG. 12, the resulting capacitive antenna regions are sufficiently decoupled for high frequency one from each other. The sufficient decoupling of the lower first antenna conductors 6b and 6c which are arranged in the lower part of the heating field to close the same heating conductors is ensured by the selection of their mutual distance 27 and their distances 26 from the neighboring busbars 4a and 4b. The distance 27 in practice amounts approximately to a half of the distance of the busbars. The third capacitive antenna region created by the upper first antenna conductor 6a is insured due to the fact that the antenna conductor 6a does not cross any heating conductors common to the lower antenna conductors 6b and 6c, and also due to that the upper antenna conductor 6a is located at the center of the window pane so that the length of the assigned heating conductors from the busbars is maximum.

Figure 13:
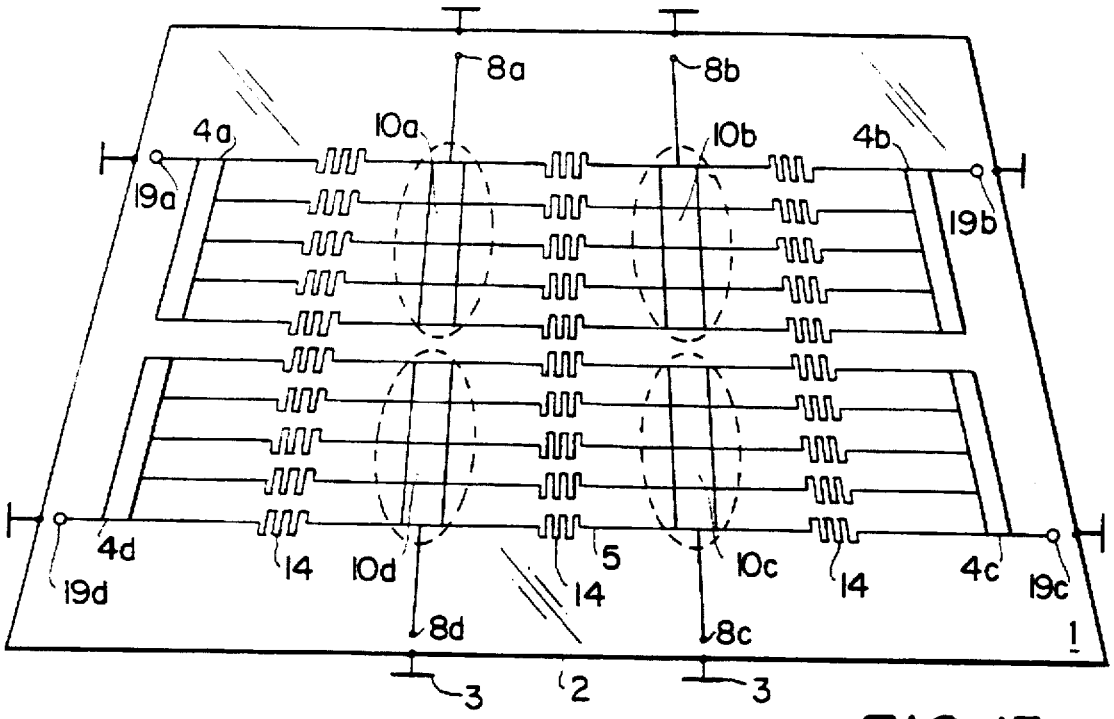
FIG. 13 shows an embodiment of an antenna system of this invention including four antennas arranged in two heating fields each having meander-like sections of the heating wires to improve decoupling of respective capacitive antenna regions.

In the event that decoupling between the capacitive antenna regions proves insufficient then it can be increased by the introduction of separating inductive elements as illustrated in FIG. 13. The inductive elements are constituted by a meander-like configuration of portions of the heating conductors between the individual capacitive antenna regions 10.

Figure 14:
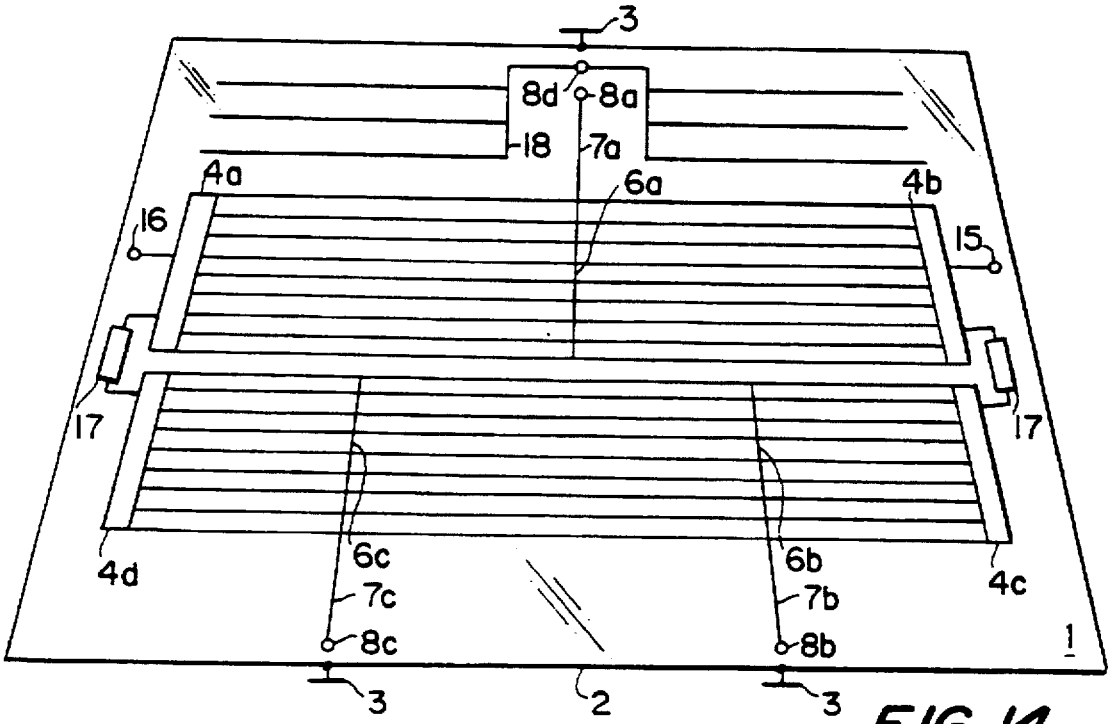
FIG. 14 shows a diversity antenna system including three antennas of this invention and a conventional fourth antenna arranged outside the heating fields.

Due to the resonance phenomena of the peripheral conductive frame 2 in connection with the entire heating surface it has proved to the of advantage to separate the busbars of respective partial heating fields in the manner as shown in FIG. 14. The separated busbars of the upper and lower heating fields are interconnected for the direct current by chokes 17 which act as insulators for high frequencies. For the reception of the broadcast on long- medium- and shortwavelengths it is necessary to provide a corresponding LMS-wave antenna in addition to the antennas having capacitive antenna regions in the heating field to receive the ultra-short wavelengths. Frequently enough space is available between the heating field and an edge of the pane to install therein a long-, medium- and shortwave antenna 18 whose received signal is tapped between the antenna terminal 8d and the grounding point 3. This tapping-off location can be also used for the reception of the ultrashort wavelengths. The antenna system of FIG. 14 has altogether four ultrashort wavelength antennas for the antenna diversity and a long-, medium-, shortwave antenna for the broadcast reception.

Figure 15:
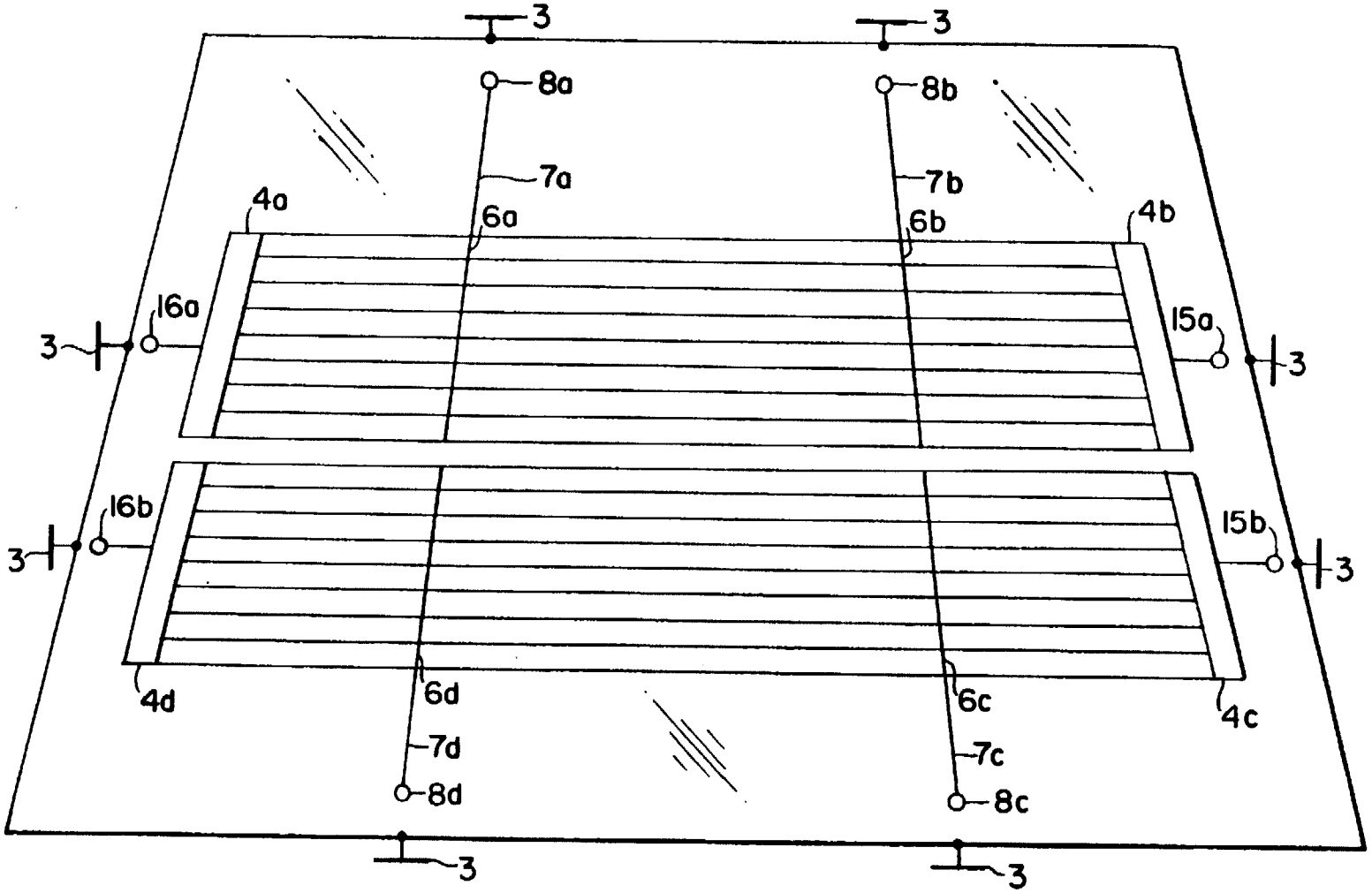
FIG. 15 shows an antenna system in accordance with the present invention with additional antennas whose antenna terminals are arranged on the busbars.

FIG. 15 shows a pan e antenna with the antenna terminals arranged on the busbars as identified by 15a and 3, 15b and 3, 16a and 3 and 16b and 3. The ground potential is identified with reference numeral 3.

Figure 16:
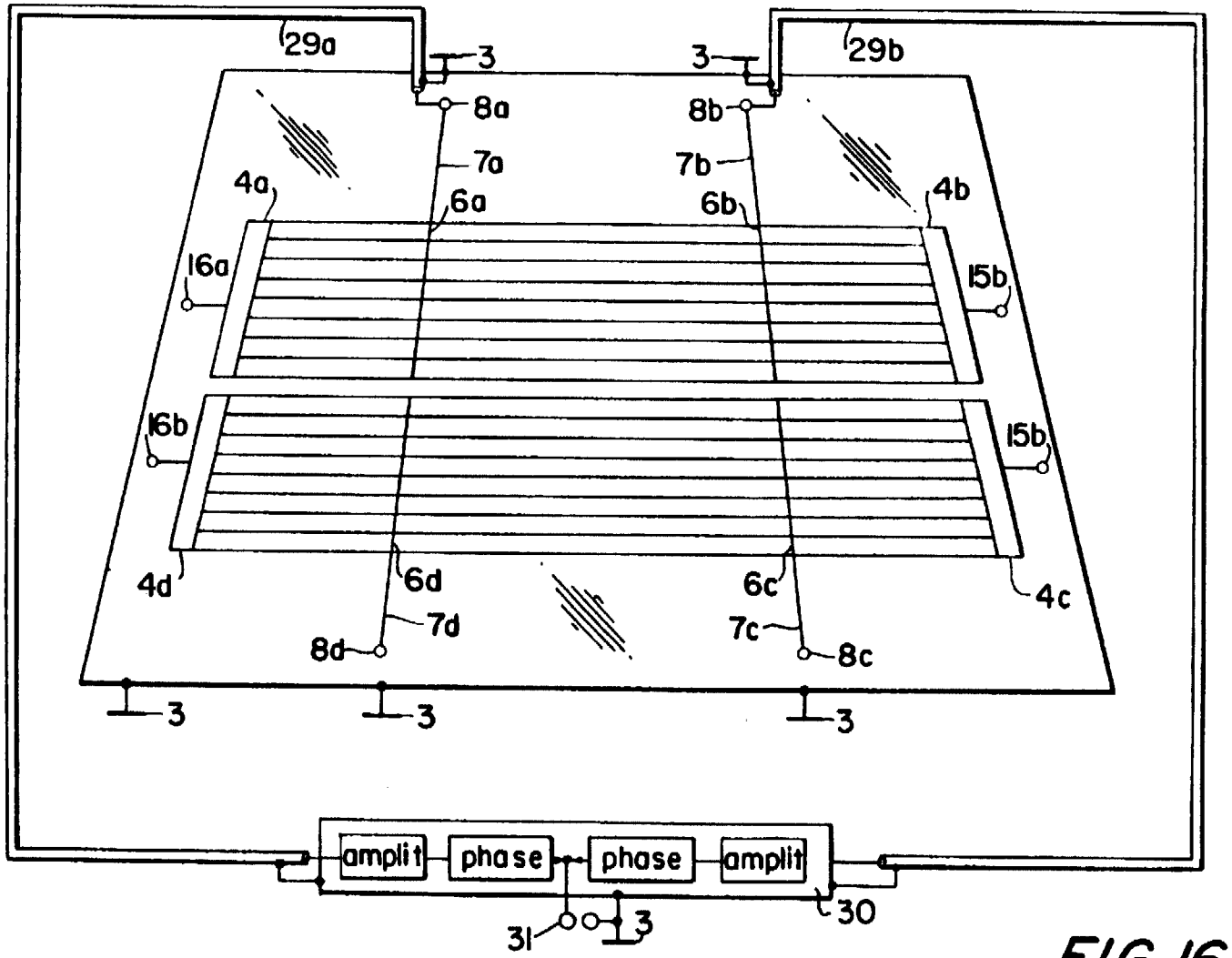
FIG. 16 shows a pane antenna system with phase and amplitude weighting networks connected with at least two pane antennas.

In FIG. 16 the antenna terminals 8a and 3 and 8b and 3 respectively, are interconnected via transmission lines 29a and 29b with a phase and amplitude weighting network 30. Each of the antenna signals can be controlled separately with respect to its amplitude and phase. Both antenna signals are added forming one receiving signal and the terminals 31 and 3, wherein 3 indicates ground potential. In the case of a transmission signal at terminals 31 and 3, this signal is split in the amplitude and phase weighting network 30 wherein each of the split signals is weighted in its amplitude and phase. Then both signals are fed to the antenna terminals 8a and 3 and 8b and 3, respectively, forming a new directional antenna pattern.

Figure 17:
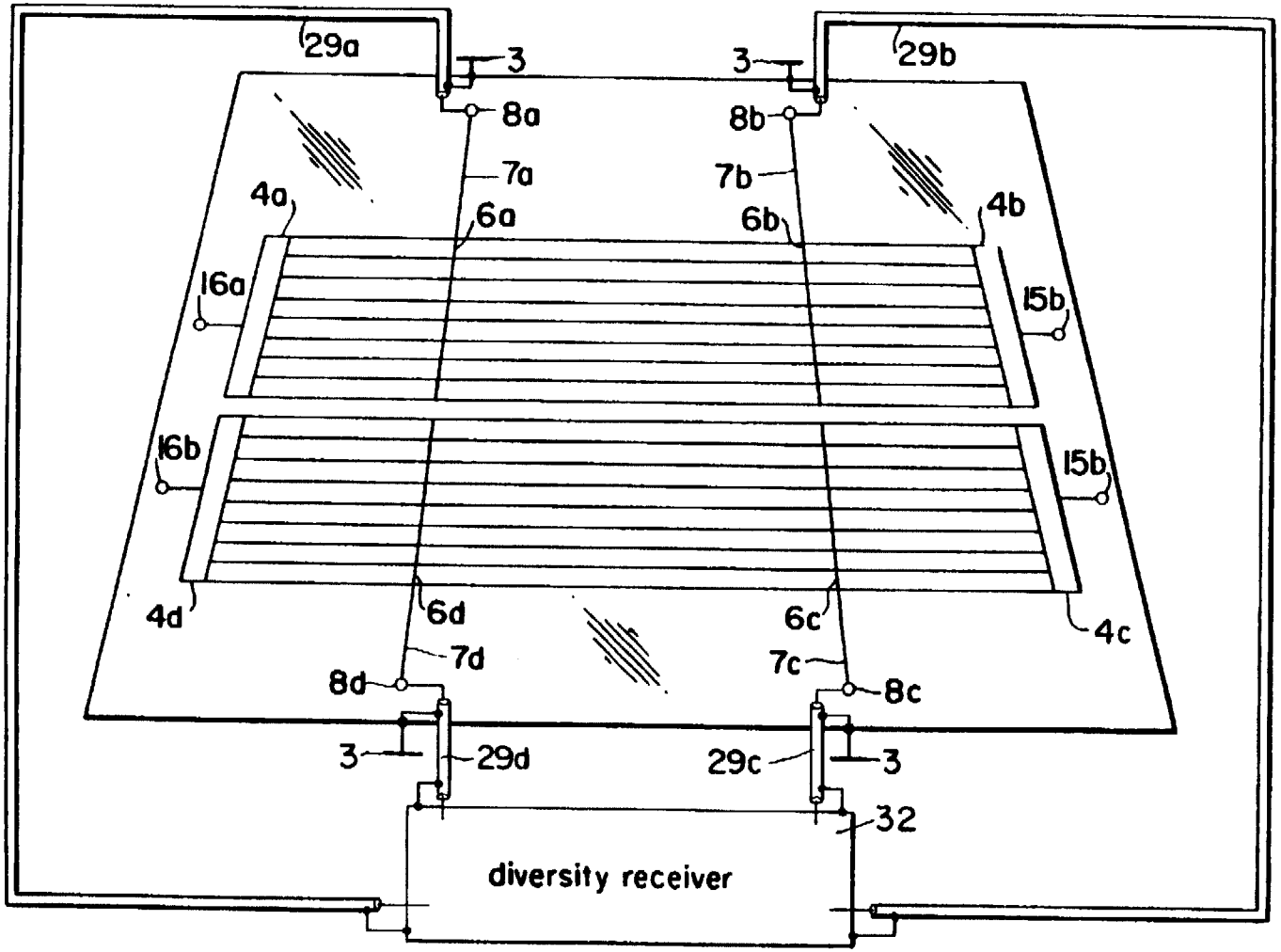
FIG. 17 shows a pane antenna system with antennas interconnected as antenna diversity system.

In an example shown in FIG. 17 the antenna signals at the terminals 8a . . . 8d and 3 are interconnected via transmission lines 29a . . . 29d to a black box 32 indicating a diversity receiver.

For the reception mode of operation of all antennas according to this invention it is of advantage to provide their antenna terminals with antenna amplifiers in order to improve their decoupling. The antenna amplifiers enable an adjustment of signal to noise ratio thus avoiding the conjugate complex impedance at the terminals during the adjustment of efficiency which in antenna diversity systems brings about an increase in undesired couplings and a decrease of mutual independency of the received signals.

The possibility to realize a plurality of individual antennas by means of capacitive antenna regions in a heating field, can be utilized both in the transmission and in the reception mode of operation also for the creation of desired directional properties of the antenna. Through a suitable interconnection of all antennas via phase- and amplitude weighting networks to form a phased array, a desired direction diagram can be more easily achieved than with a smaller number of available antennas.

In summary, the antennas of the invention possess the following advantages:

- A small number of decoupling networks for the supply of heating direct current;
- If the decoupling networks are used they are relatively small and inexpensive to install;
- The creation of the capacitive antenna regions in the center area of the window pane permits in the reception mode of operation the neutralization of stronger electromagnetic fields present in the central area. Accordingly, in the transmission mode of operation a particularly effective coupling of the antenna to the radiation field is made possible;
- Due to the horizontal orientation of the heating conductors and the substantially vertical orientation of the second antenna conductors it is possible to design antennas having a unipolar characteristics and a vertical polarization which is particularly suitable for reception of the vertically polarized waves;
- Simple production, in a two component compound or laminated pane through the insertion of thin conductors between component glass pane of the compound and in the case of a single pane safety windows by printing complex conductor structures on the surface;
- The possibility to apply large number of different antennas in a predetermined area of a heating field to realize different diversity antennas;
- The possibility to install a large number of single antennas in a single heating field of a predetermined area to create phased arrays for achieving desired radiation diagrams.

What is claimed as new and desired to be protected by Letters Patent is set forth in the appended claims:

1. A pane antenna for a very high frequency range and/or an ultra-high frequency range, said pane antenna comprising a field of parallel heating conductors arranged on a window pane between two transverse busbars for applying direct current to the heating conductors; at least one wire-shaped conductor forming a first antenna conductor crossing at right angles to at least a part of said heating conductors at crossing points between the first antenna conductor and the heating conductors of said part, said first antenna conductor and said parallel heating conductors being coupled by galvanic connection at a low impedance for an effective frequency range in the region of said crossing points to create a capacitive antenna region adjoining said crossing points; an antenna terminal provided on said window pane outside said field of heating conductors; another at least one wire-shaped conductor forming a second antenna conductor connected at one end thereof to said antenna terminal and, at the other end thereof, being coupled at a low impedance for said effective frequency range to said first antenna conductor, so that said first antenna conductor is coupled to said antenna terminal only through said second antenna conductor and to said heating conductors while said second antenna conductor is coupled only with said first antenna conductor and said antenna terminal and means for supplying direct current to the busbars without additional network means for increasing impedance connected between the busbars and the vehicle body; and wherein said two transverse busbars are arranged so that each of said heating conductors extends between and is connected with said busbars, said heating conductors have a relatively large inductive impedance per length unit and a distance from said first antenna conductor to each of said busbars is sufficiently large so that said busbars are sufficiently decoupled for said very high frequency range and/or said ultra-high frequency range from said capacitive antenna region.

2. A pane antenna as defined in claim 1, further comprising an electrically conductive frame surrounding said window pane.

3. A pane antenna as defined in claim 1, wherein said crossing points coincide with points of the same potential on said heating conductors.

4. A pane antenna as defined in claim 1, further comprising additional conductor sections galvanically connected to said first antenna conductor and extending parallel to each other between respective heating conductors.

5. A pane antenna as defined in claim 1; and further comprising ornamental or descriptive signs composed of electrically conductive material and coupled for high frequencies to the heating conductors.

6. A pane antenna as defined in claim 2, wherein said antenna terminal is located in proximity to a rim of the window pane and a grounding point is located opposite said antenna terminal.

7. A pane antenna as defined in claim 1, wherein said capacitive antenna region is located approximately midway between the two busbars.

8. A pane antenna as defined in claim 1, further comprising an antenna amplifier attached to said antenna terminal to provide an active reception antenna.

9. A pane antenna for a very high frequency range and/or an ultra-high frequency range, said pane antenna comprising a field of parallel heating conductors arranged on a window pane between two transverse busbars for applying direct current to the heating conductors; a plurality of first antenna conductor members crossing at least a portion of said heating conductors at right angles at crossing points between the first antenna conductor and the heating conductors of said part, said first antenna conductor members and said parallel heating conductors being coupled by galvanic connection at a low impedance for an effective frequency range in the region of said crossing points to create a capacitive antenna region adjoining said crossing points; an antenna terminal provided on said window pane outside said field of heating conductors; a second antenna conductor connected at one end thereof to said antenna terminal and, at the other end thereof, being coupled at a low impedance for said effective frequency range to said first antenna conductor members, so that said first antenna conductor members are coupled to said antenna terminal only through said second antenna conductor and to said heating conductors while said second antenna conductor is coupled only with said first antenna conductor members and said antenna terminal, and means for supplying direct current to the busbars without additional network means for increasing impedance connected between the busbars and the vehicle body; and wherein said two transverse busbars are arranged so that each of said heating conductors extends between and is connected with said busbars, said heating conductors have a relatively large inductive impedance per length unit and said first antenna conductor members are each spaced a sufficiently large distance from each of said busbars so that said busbars are sufficiently decoupled for said very high frequency range and/or said ultra-high frequency range from said capacitive antenna region.

* * * * *